United States Patent [19]

Zouzoulas

[11] Patent Number: 4,765,607

[45] Date of Patent: Aug. 23, 1988

[54] STACKER APPARATUS

[75] Inventor: John Zouzoulas, Havertown, Pa.

[73] Assignee: Mars, Incorporated, McLean, Va.

[21] Appl. No.: 709,559

[22] Filed: Mar. 8, 1985

[51] Int. Cl.[4] ..... G07F 1/06

[52] U.S. Cl. ..... 271/177; 198/814; 198/575; 271/162; 271/181; 271/214

[58] Field of Search ..... 271/180, 181, 177, 178, 271/179, 214, 218, 198, 145, 149, 150, 157, 162, 163; 198/814, 575, 583, 586, 813, 814, 861.2; 187/18, 8.71; 305/10; 414/28, 103, 108, 109; 227/197

[56] References Cited

U.S. PATENT DOCUMENTS

| | | | |
|---|---|---|---|
| 1,247,130 | 11/1917 | Meyer | 271/181 |
| 1,917,517 | 7/1933 | Goepel | 232/4 R |
| 2,488,674 | 11/1949 | Malott | 271/68 |
| 2,595,346 | 5/1952 | Federwitz | 271/87 |
| 2,629,484 | 2/1953 | Thomson | 198/861.2 |
| 3,026,023 | 3/1962 | Hirschfeld | 232/4 |
| 3,064,785 | 1/1962 | Weingart | 194/4 |
| 3,072,237 | 1/1963 | Simijian | 194/4 |
| 3,148,879 | 9/1964 | Kistner | 271/176 |
| 3,222,057 | 12/1965 | Couri | 271/3 |
| 3,655,186 | 4/1972 | Bayha | 271/88 |
| 3,701,523 | 10/1972 | Erickson | 270/67 |
| 3,731,799 | 5/1973 | Meloni et al. | 209/111.7 |
| 3,749,398 | 7/1973 | Fujita et al. | 271/86 |
| 3,765,523 | 10/1973 | Nakanishi | 194/4 R |
| 3,783,989 | 1/1974 | Jensen | 194/4 G |
| 3,788,333 | 1/1974 | Johnson | 133/2 |
| 3,791,392 | 2/1974 | Hanson | 133/1 R |
| 3,851,744 | 12/1974 | Erickson | 194/4 R |
| 3,917,260 | 11/1975 | Okkonen et al. | 271/181 |
| 3,934,693 | 1/1976 | Ooyama et al. | 194/4 R |
| 3,977,669 | 8/1976 | Douno | 271/180 |
| 4,000,892 | 1/1977 | Novak et al. | 271/180 |
| 4,011,931 | 3/1977 | Wyckoff | 194/4 C |
| 4,020,972 | 5/1977 | Lundblad | 221/13 |
| 4,023,011 | 5/1977 | Nakajima et al. | 235/61.11 R |
| 4,025,420 | 5/1977 | Horino | 209/74 R |
| 4,045,017 | 8/1977 | Lundblad | 271/181 |
| 4,050,562 | 9/1977 | Schwippert et al. | 194/4 |
| 4,127,180 | 11/1978 | Coffman | 305/10 |
| 4,197,045 | 4/1980 | Stauber | 414/30 |
| 4,258,909 | 3/1981 | Müller | 271/181 |
| 4,325,277 | 4/1982 | Uchida et al. | 83/205 |
| 4,363,584 | 12/1982 | Kokubo | 414/33 |
| 4,365,700 | 12/1982 | Arimoto et al. | 194/2 |
| 4,418,824 | 12/1983 | Gorgone et al. | 209/534 |
| 4,447,714 | 5/1984 | Lundblad | 235/379 |
| 4,459,052 | 7/1984 | Lundblad | 400/124 |
| 4,479,049 | 10/1984 | Hirose | 235/379 |
| 4,504,052 | 3/1985 | Murck et al. | 271/9 |
| 4,512,263 | 4/1985 | Lanning | 271/181 |
| 4,540,081 | 9/1985 | Mori et al. | 194/4 |
| 4,556,139 | 12/1985 | Akagawa et al. | 194/4 |

FOREIGN PATENT DOCUMENTS

| | | | |
|---|---|---|---|
| 0099324 | 1/1984 | European Pat. Off. . | |
| 0106109 | 4/1984 | European Pat. Off. . | |
| 2270147 | 12/1975 | France . | |
| 2453811 | 11/1980 | France . | |
| 52-27700 | 3/1977 | Japan . | |
| 55-48213 | 3/1980 | Japan . | |
| 55-49793 | 4/1980 | Japan . | |
| 57-132291 | 8/1982 | Japan . | |
| 58-60644 | 4/1983 | Japan . | |
| 58-85267 | 6/1983 | Japan . | |
| 60-92367 | 6/1985 | Japan . | |
| 8200022 | 1/1982 | PCT Int'l Appl. . | |
| 1539673 | 1/1979 | United Kingdom . | |
| 2017657 | 10/1979 | United Kingdom | 271/214 |
| 1573423 | 8/1980 | United Kingdom . | |

*Primary Examiner*—Andres Kashnikow
*Assistant Examiner*—Matthew C. Graham
*Attorney, Agent, or Firm*—Davis Hoxie Faithfull and Hapgood

[57] ABSTRACT

An improved banknote stacker is described which provides a high level of flexibility and a high degree of stacking efficiency with a reduced level of jams and crumpled banknotes. In one embodiment the improved banknote stacker includes upper and lower housings having molded fingers and slots for interconnection with a banknote validator, banknote transport apparatus including a self adjusting belt-pulley arrangement, a prestorage compartment, a banknote pusher having a home sensing arrangement which allows it to be controlled using a simple open-loop control, and a banknote magazine for storing stacked banknotes and providing ready access to the stacked banknotes.

30 Claims, 10 Drawing Sheets

STACKER APPARATUS

FIELD OF THE INVENTION

The present invention relates to an improved banknote stacker apparatus for stacking paper currency. It also relates to an improved validator-stacker unit for validating and then stacking acceptable banknotes, in which a stacker may be readily attached to and detached from a validator which may be used alone or in conjunction with the stacker. In particular, the improved stacker apparatus according to the present invention operates in conjunction with a banknote validator which receives a banknote from a customer, verifies that the banknote is acceptable and provides an electrical signal indicating that the banknote is acceptable. The improved stacker apparatus takes banknotes which are accepted by the banknote validator and compactly and neatly stores them.

BACKGROUND OF THE INVENTION

In some applications, a banknote validator feeds accepted banknotes to a bin or storage container where they are loosely stored. For example, some vending machines include a banknote validator so that paper currency can be accepted for the purchase of expensive items for which it is onerous for a customer to pay in coins. Currency which is accepted is fed from the outlet of the currency validator to a cashbox where it is loosely stored until collected by the vending machine's owner. In other vending machines, space may be at a greater premium or for other reasons it may be highly desirable to compactly and neatly stack accepted currency rather than loosely storing it.

As a result, various stacker arrangements have been previously developed. See, for example, U.S. Pat. No. 4,050,562 assigned to the assignee of the present application, and U.S. Pat. Nos. 4,011,931, 4,000,892, 3,977,669, 3,917,260, 3,851,744, 3,788,333, 3,765,523, 3,655,186 and 3,222,057. Two commercially used stacker arrangements are briefly described below. In the first, a banknote which has been accepted by a validator is allowed to fall under the influence of gravity into a first compartment of a stacker, a pusher unit then pushes the fallen banknote into a stack in a storage compartment of the stacker. This arrangement does not maintain positive control over a banknote. As a result, jams and poorly stacked banknotes are likely to occur more frequently than is desirable. Such less than optimal operation is more frequently observed where worn, old banknotes are being stacked.

In a second commercial arrangement, a stacker is included as part of an integral validator-stacker unit. In this unit, a common drive belt provides for positive control of a banknote's movement from insertion until it is stacked. This integral arrangement is mechanically complex and lacks the flexibility to make it readily adaptable to meet a wide range of different applications. This second arrangement limits stacking to a single direction, and does not allow the operation of its validator without its stacker.

SUMMARY OF THE INVENTION

The apparatus of the present invention provides flexibility and adaptability while achieving a reduced level of jamming and improper stacking. These improvements, as well as positive banknote control, are achieved while using fewer electronic and mechanical components than found in currently available validator-stacker units which maintain positive control of banknotes during handling. As a result, both the stacker and the combined validator-stacker unit according to the present invention are relatively compact. The stacker of the present invention is readily attached to a validator and, in normal service, requires no adjustments to maintain proper belt tension, bill path alignment or belt speed control.

It is an object of this invention to provide a validator-stacker combination that maintains positive control of a banknote from its insertion into the validator until it is stacked.

It is a further object of this invention to provide a stacker that requires no mechanical or electrical adjustments to compensate for normal manufacturing tolerances, the wear and tear of parts during normal operation, or typical changes in environmental conditions during operation.

It is also an object of this invention to provide a mechanical interface system to a validator which allows the stacker to be readily designed so as to stack banknotes in an upward, downward or horizontal direction.

It is also an object of this invention to provide a simple mounting scheme to allow a person to mount the stacker to a validator on-site without the need for undue alterations or adjustments which would make it necessary to make the installation off-site.

It is an additional object of this invention to provide an easily replaceable banknote magazine to allow flexibility in the number of banknotes stacked by simply changing magazines to obtain different capacities.

A further objective of this invention is to provide a stacker with a reduced number of components that insures proper banknote positioning thereby eliminating the need for multiple sensors commonly used to detect banknote position, and requiring only a single sensor to detect both the home position of the pusher and the stacker full condition.

Another object of this invention is to provide a system which makes efficient use of the space available to stack the maximum number of banknotes in a given stacker volume and to insure that the stack is without crumpled banknotes.

A further object of this invention is to provide a cam and scissor design for a banknote pusher which allows simple open-loop motor control while insuring accurate home position detection.

Another object of this invention is to provide a banknote magazine which is simply and positively fastened closed and has multiple methods for removing banknotes to account for variations in mounting requirements.

It is also an object of this invention to provide a system for maintaining a relatively constant speed of banknote transport through a validator whether the validator is used to drive a stacker or not, while maintaining a low cost open-loop speed control system for controlling the validator's banknote transport system.

Another object of this invention is to provide a stacker that is low in cost and simple to assemble.

Another objective of this invention is to have the banknote magazine be separable from the stacker at a non-critical area such that important alignments are not affected by the removal or opening of the banknote magazine.

A further object is to provide a banknote magazine which includes no electronic components so that one banknote magazine can be replaced by another without affecting the stacker's electronic system in any way, and without having to make or break any electrical connections.

These and other objects will be apparent from the following detailed description. It will also be apparent that an embodiment of the invention need not achieve all of the above objects to come within the scope of the present invention as defined by the claims.

Throughout this specification and the claims, where reference is made to a "banknote" or "banknotes", the reference is intended to include all types of paper currency and the like. Similarly, where reference is made to the "face" of a banknote or banknotes, the reference is intended to include either major surface.

DETAILED DESCRIPTION

Figure 1:
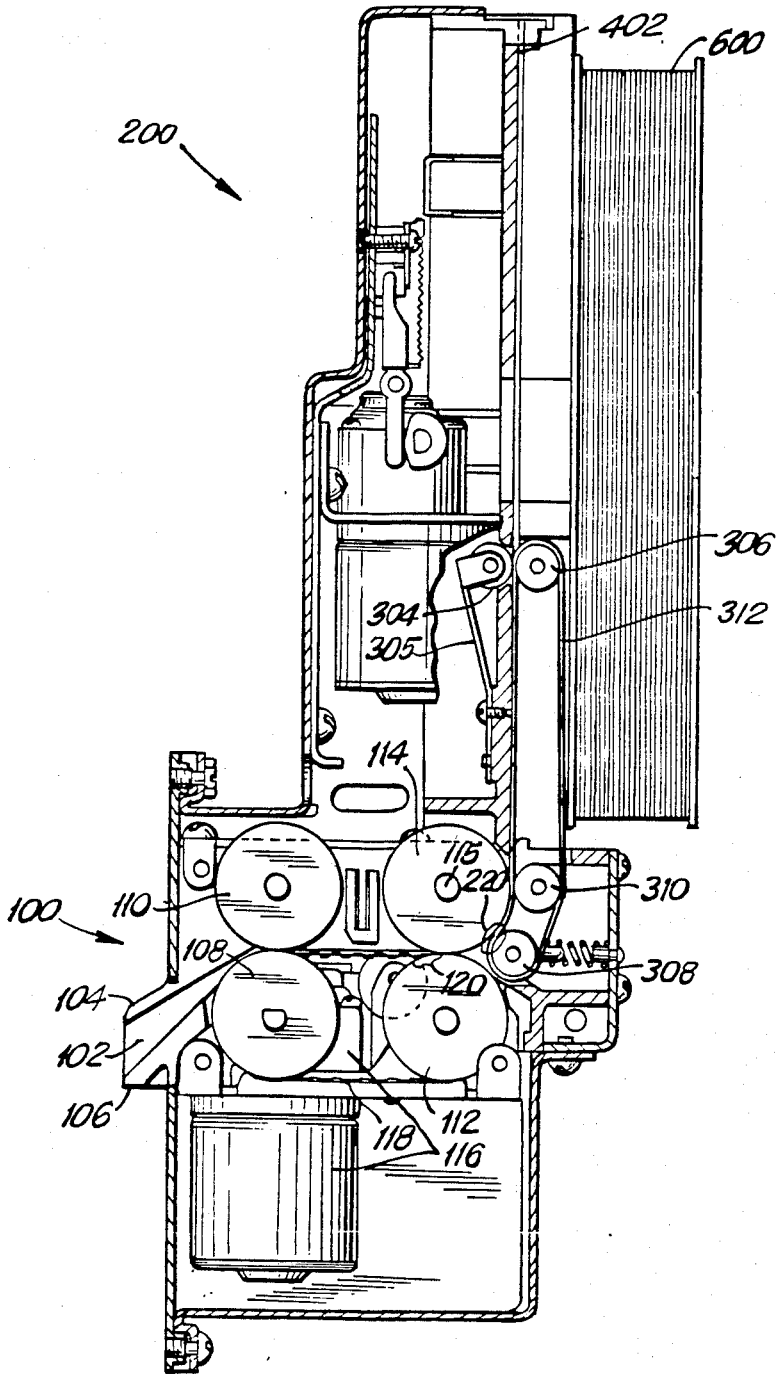
FIG. 1 is an elevational side view of one embodiment of a stacker apparatus according to the present invention, connected with a banknote validator unit so as to illustrate one embodiment of a validator-stacker unit according to the present invention.
Figure 2A:
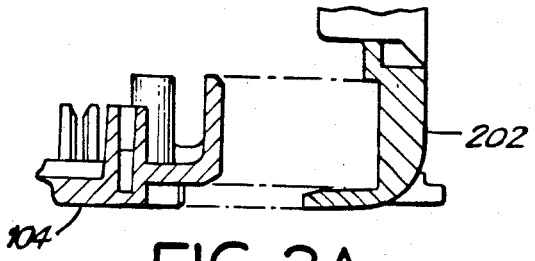
FIGS. 2A and 2B are top and side views respectively of an upper housing interlocking finger and slot arrangement for connecting the banknote validator and stacker in a unit as shown in FIG. 1.
Figure 2B:
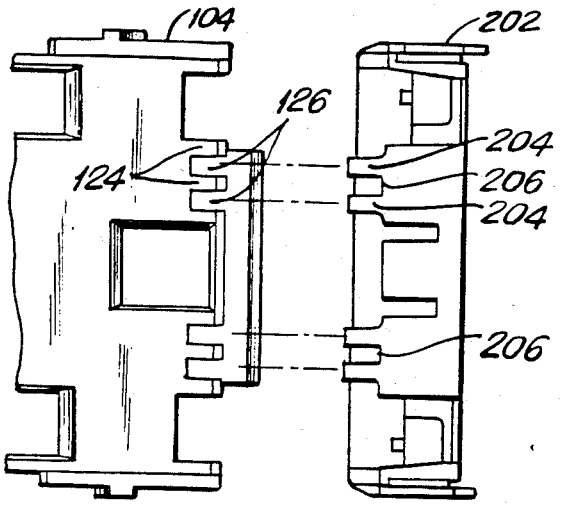
Figure 3A:
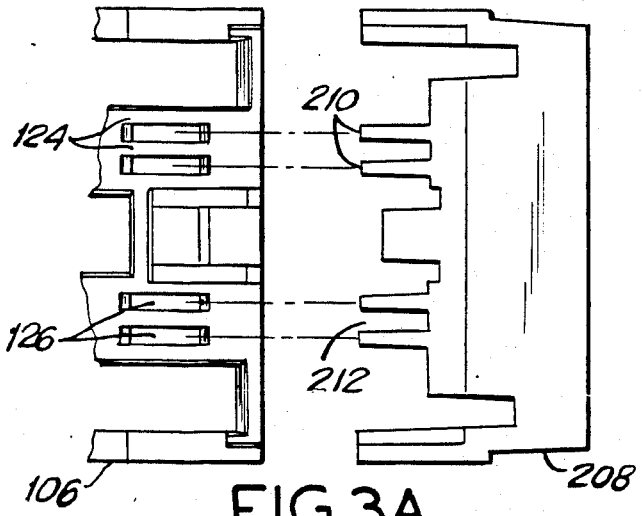
FIGS. 3A and 3B are top and side views of a lower housing interlocking finger and slot arrangement for connecting the banknote validator and stacker in a unit as shown in FIG. 1.
Figure 3B:
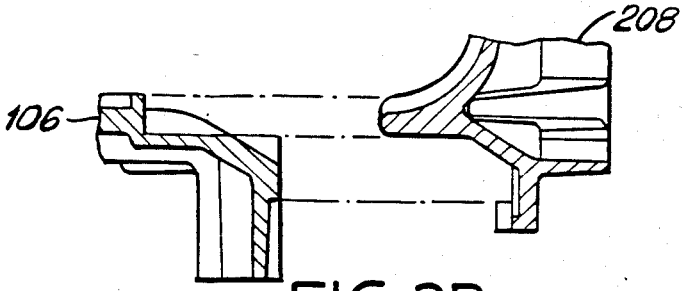
Figure 4:
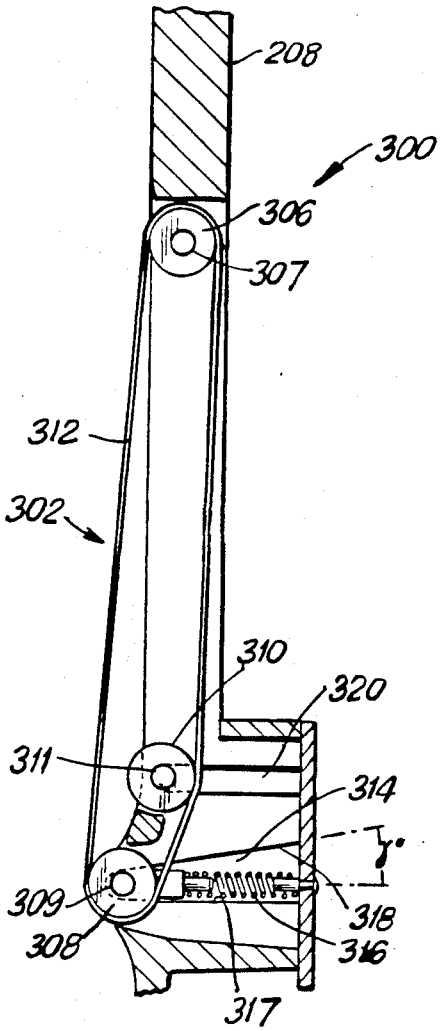
FIG. 4 is a detail drawing of the banknote transport arrangement of the stacker of FIG. 1.
Figure 5:
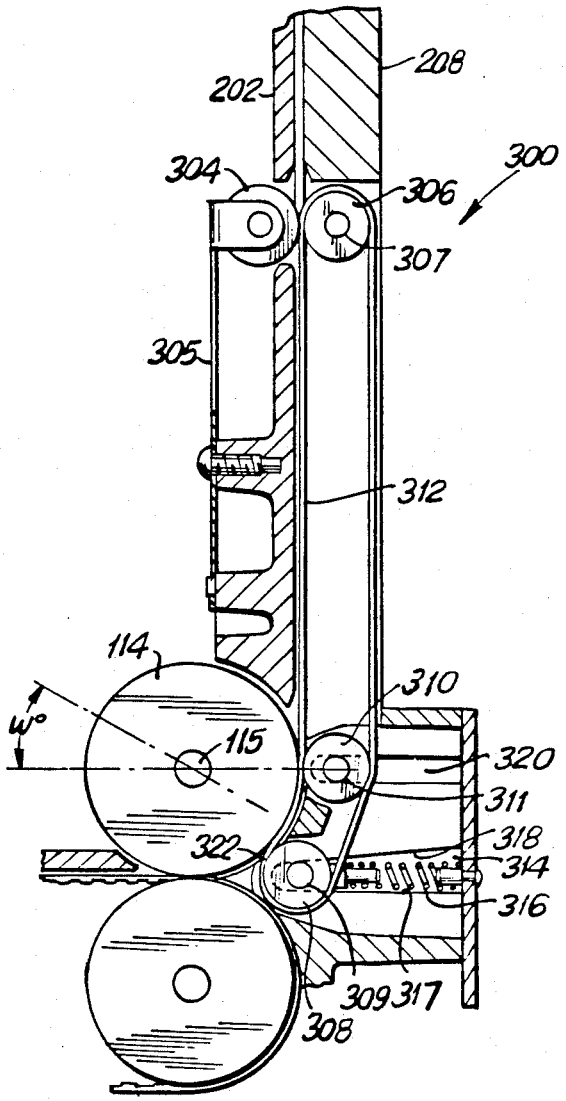
FIG. 5 is a second drawing of the banknote transport apparatus of the stacker of FIG. 1 showing the transport apparatus when the stacker is connected to the banknote validator.
Figure 6:
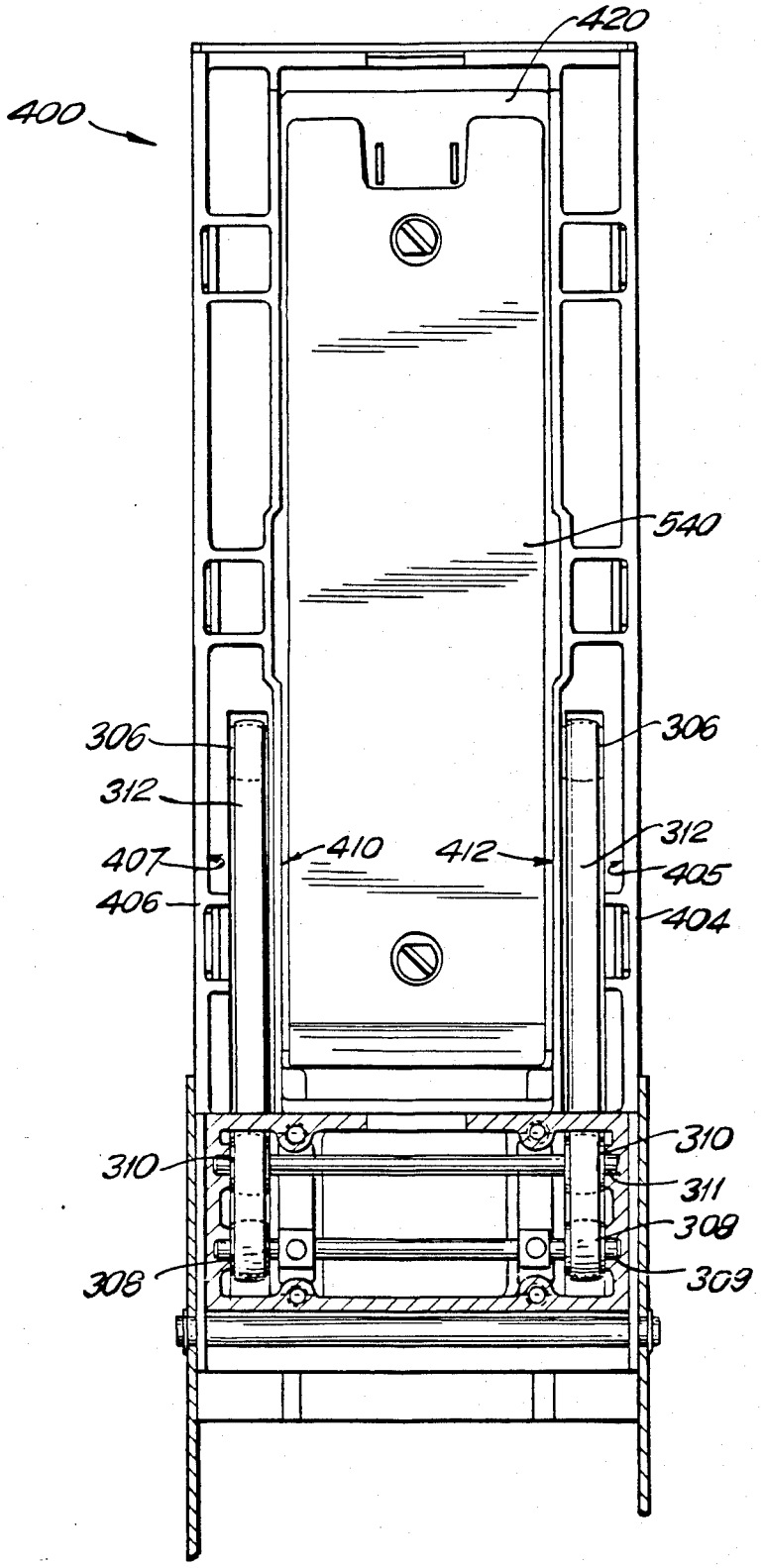
FIG. 6 is a front view of the prestorage compartment of the stacker of FIG. 1 which defines the upper portion of the banknote's path in the stacker.
Figure 7:
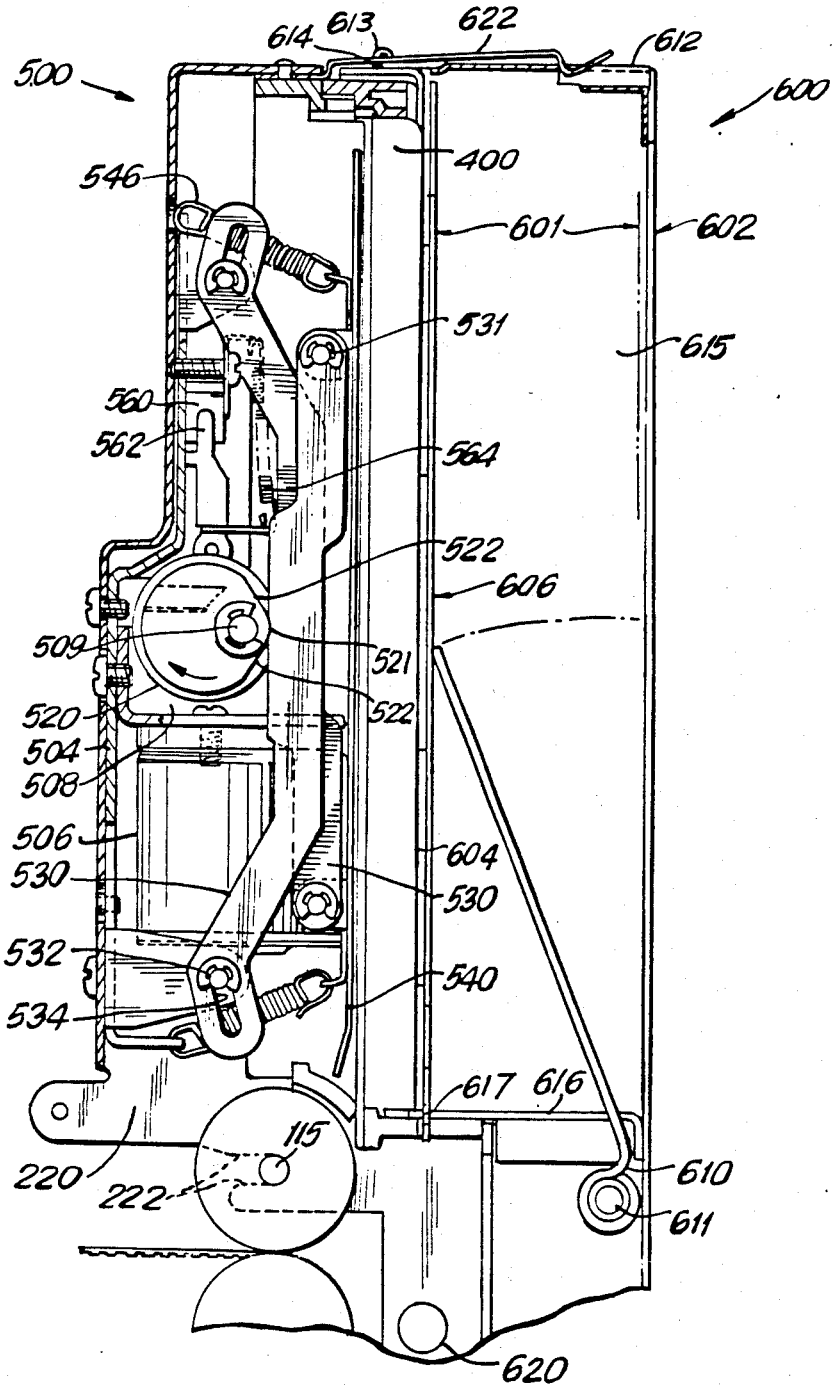
FIG. 7 is an elevational side view illustrating the pusher and banknote magazine of the stacker of FIG. 1 when the pusher plate is in its home position.
Figure 8:
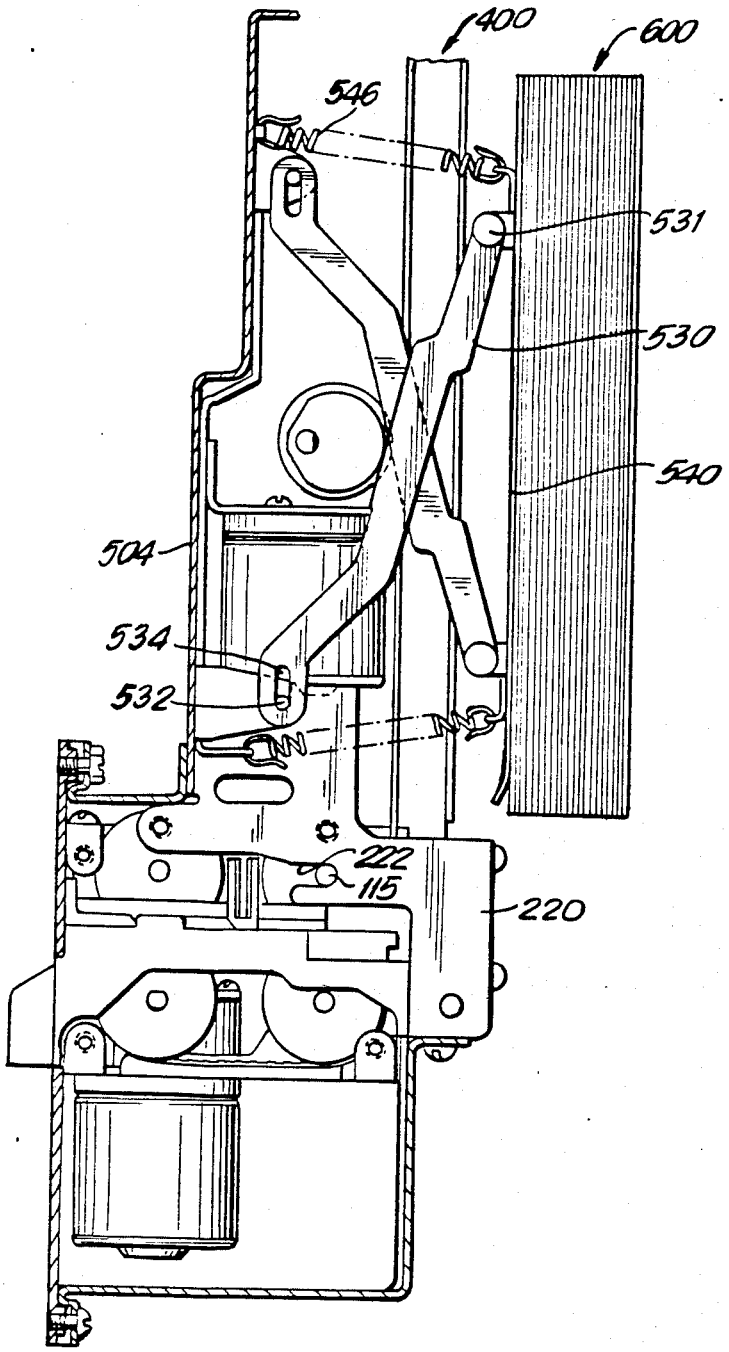
FIG. 8 is an elevational side view illustrating the pusher plate of FIG. 7 away from its home position.

One embodiment of the present invention is shown in FIGS. 1–13. FIG. 1 shows an overall view of a banknote validator 100 connected to a stacker 200 to form a validator-stacker unit. The stacker 200 incorporates several major component groups: banknote transport means 300 which is best illustrated in FIGS. 4 and 5, pre-storage compartment 400 which is best illustrated in FIG. 6, pusher means 500 which is best illustrated in FIGS. 7 and 8, and banknote magazine 600 which is best shown in FIG. 7.

The details of validator 100 pertaining to banknote validation are not part of this invention. As a result, those aspects of the validator are not discussed further below. Various aspects of the electrical and mechanical connection of the validator 100 and the stacker 200 do form a part of this invention and are further described below.

The validator 100 employed in the embodiment illustrated in FIGS. 1–13 and described herein is a commercially available unit sold by Mars Electronics, Folcroft, Pa. That validator is generally as described in U.S. patent application Ser. No. 659,411 filed Oct. 10, 1984 and assigned to the assignee of the present application.

Figure 13:
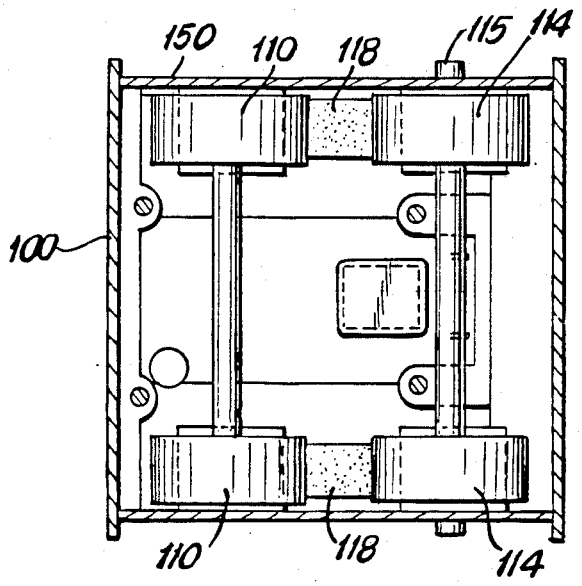
FIG. 13 is a plan view of the banknote transport apparatus of the validator of FIG. 1.

The validator 100 determines whether inserted banknotes are acceptable. Banknotes are inserted one at a time into validator 100 at a banknote entrance 102 which is defined by an upper housing 104 and a lower housing 106. From entrance 102, a banknote is transported lengthwise through the validator to the validator's banknote output by a series of pairs of pulleys or rollers 108, 110, 112 and 114, and a pair of belts 118, which are driven by a drive means 116 including a motor and drive train. FIG. 13 illustrates the preferred arrangement of the upper pairs of rollers 110 and 114 and the belts 118. As shown in FIG. 13, the rollers 114 are mounted on a shaft 115 whose ends extend beyond casing 150 of validator 100. For the sake of clarity, throughout the remaining discussion, only a single set of belts and pulleys will be discussed; however, it should be realized that in the preferred embodiment there are two sets of components and that the edge portions of a banknote are controlled by these components while the central portion of the banknote passes between them.

While a banknote is transported edgewise through the validator 100, it is tested by a group of sensors to ascertain its validity and denomination. Output signals from the sensors are processed by logic circuits in validator 100 to determine whether the banknote is acceptable. A banknote which is found unacceptable is ejected back through entrance 102 by reversing the drive means 116.

An acceptable banknote is driven by the belt 118 and the rollers 112 and 114 into an interconnection region 120 in which the validator 100 and the stacker 200 make their connection together. As further discussed below, in connection with FIGS. 2A, 2B, 3A and 3B, interconnection means in the interconnection region 120 establish a smooth uninterrupted path for a banknote to follow in leaving validator 100 and entering stacker 200.

As shown in FIG. 1, and in greater detail in FIGS. 4 and 5, stacker 200 includes transport means 300 having a series of pulleys 306, 308 and 310, a belt 312, and a roller 304. The transport means 300 is driven by the roller 114 as will be discussed in greater detail below.

Transport means 300 transports the accepted banknote from the stacker's entrance into a pre-storage compartment 400. Compartment 400 frames the banknote and holds it stiff. The dimensions of compartment 400 are chosen so that crumpling and jamming of accepted banknotes are prevented.

After a predetermined amount of time sufficient to allow the accepted banknote to be fully driven into compartment 400 so that its leading edge has reached stop 402, a pusher means 500 is operated. Pusher means 500 forces the accepted banknote from prestorage compartment 400 into a stack in banknote magazine 600 where it is stored until removed. As will be discussed below, the magazine 600 is designed to be readily removed or opened so that stacked banknotes can be removed. Now that the overall operation from bill insertion to stacking and removal has been briefly discussed, the details of this embodiment of apparatus according to the present invention will be described in greater detail.

Interconnection of Validator and Stacker

When the leading edge of a banknote reaches the region 120 shown in FIG. 1, it begins to leave the validator 100. Both the upper housing 104 and the lower housing 106 of the validator have interconnection means comprising integrally formed fingers 124 and slots 126 in the region 120 as shown in detail in FIGS. 2A and 2B (upper housing detail) and 3A and 3B (lower housing detail).

When validator 100 is used without stacker 200, the fingers 124 of the upper housing 104 mesh with slots in an end cap which is not shown. The slots for the end cap are the same as slots 206 shown in FIG. 2B. In conjunction with the surface of the lower housing 106, the end cap defines an exit way which directs accepted bills downwardly out of bill validator 100 at an angle of roughly 30° from the horizontal.

When stacker 200 is used with validator 100, fingers 204 and slots 206 of the stacker's upper housing 202 mesh with the slots 126 and fingers 124 of upper housing 104 of validator 100. Fingers 210 and slots 212 of lower housing 208 mesh with slots 126 and fingers 124 of lower housing 106 of validator 100. The meshing of these fingers and slots with their corresponding slots and fingers in the validator's upper and lower housings results in a smooth and uninterrupted banknote path from validator 100 into stacker 200. This type of path avoids malfunctions due to jamming which might otherwise occur as the banknote makes the transition from validator to stacker.

Additionally, in the preferred embodiment, proper alignment of the validator 100 and stacker 200 is further ensured by shaft 115 fitting into slot 222 in casing 220 of the stacker 200 (FIG. 7). Such an arrangement comprises interconnection means for aligning the stacker and validator. Surfaces of stacker upper and lower housings 202 and 208 define a banknote receiving means comprising passageway walls which establish an initial portion of the banknote passageway in the stacker. These passageway walls guide a banknote around a corner and vertically upwards into the banknote transport means 300. In a preferred embodiment the banknote passageway walls are molded to include at least one finger and slot. It should be apparent that consistent with the present invention a banknote could be directed horizontally, or vertically downwards with only minor modifications. While the banknote receiving means of the preferred embodiment is shown and described, other less sophisticated banknote receiving means might be used in other embodiments. For example, an open space defined by sidewalls might suffice to receive a gravity fed banknote in position relative to a pusher.

Banknote Transport Means

As the leading edge of the banknote reaches region 220 (shown in FIG. 1) of the stacker 200, it begins to enter the stacker's banknote transport means 300. Transport means 300 is shown in detail in FIGS. 4 and 5. Transport means 300 includes a belt-pulley arrangement 302 which is driven by the validator roller 114 (which will also be referred to as the stacker driving roller) to transport banknotes edgewise. As shown, transport means 300 is frictionally driven, but it will be apparent other drive arrangements could be used, and that transport means 300 could be otherwise engaged with the drive means of validator 100. Transport means 300 also includes a roller 304 which is biased against belt 312 and pulley 306 by a leaf spring 305.

The belt-pulley arrangement 302 includes locating pulley 306, belt tension pulley 308, floating pulley 310, and belt 312 which are arranged as described below, and shown in FIGS. 4 and 5. As illustrated in FIG. 6, and as discussed above in connection with FIG. 12 and the validator's banknote pulleys and belts, two sets of components are used in transport means 300 with one set on each edge of the banknote path; however, only a single set is discussed.

Locating pulley 306 is mounted on and free to rotate about a pulley pin 307 which is secured to a wall of prestorage compartment 400 in a fixed position relative to the banknote path. The roller 304 is located in stacker housing 202 and opposite locating pulley 306. Once the lagging edge of the banknote is clear of stacker driving roller 114 and floating pulley 310, the locating pulley 306 and the roller 304 provide the force to drive the banknote up to stop 402 and fully into compartment 400. The leaf spring 305 provides sufficient force to prevent the banknote from slipping once stacker driving roller 114 stops turning; however, this force is insufficient to crumple or jam a bill and it is small enough so that belt 312 slips against the banknote once the banknote's leading edge reaches stop 402 until drive roller 114 is stopped. This controlled slippage is important; in the preferred embodiment driver roller 114 is operated for a predetermined time which is slightly longer than that required to drive the leading edge of a banknote to the stop 402, and then it is turned off. Without slippage, a sensor would have to be used to sense when a banknote was fully in or nearly fully in prestorage compartment 400 so that drive means 116 could be turned off. Otherwise jamming or crumpling of the banknote would result. Such a sensor and associated control circuitry may be readily added, but such an addition adds overall cost and complexity to the system.

Returning to the belt pulley arrangement 302, the belt tension pulley 308 of that arrangement is mounted on and free to rotate about a shaft 309. The ends of shaft 309 are located in an opening 314 in housing 208. Shaft 309 is biased into the opening 314 by the force of spring 316. The opening 314 is a slot having its lower boundary defined by a horizontal wall 317 and its upper boundary defined by a wall 318 which is at an angle of $\gamma°$ to wall 317 and the banknote path between the rollers 108 and 112, and 110 and 114. The preferred value for angle $\gamma$ for this embodiment is approximately 6°.

Finally, floating pulley 310, the third pulley of belt-pulley arrangement 302, is positioned between locating pulley 306 and belt tension pulley 308. Floating pulley 310 is mounted on and free to rotate about shaft 311. Shaft 311 is located in a slot 320 in the housing 208. The slot 320 is parallel to the banknote path between the rollers of validator 100.

When stacker 200 is not mounted to the validator 100, the belt-pulley arrangement 302 arranges itself as shown in FIG. 4. The belt pulley arrangement 302 provides a relatively constant tension in belt 312 independent of minor variances in the manufacturing tolerances of the components included in that arrangement. As an example of such manufacturing tolerances, belt 312 may vary in length by up to 1/16 of an inch. A vector analysis of the relative forces on the components of the belt-pulley arrangement 302 will illustrate mathematically how the arrangement is self-adjusting.

FIG. 5, however, visually illustrates the self-adjusting nature of belt-pulley arrangement 302. When validator 100 is attached to stacker 200, pulleys 308 and 310 move as shown in FIG. 5. Pulley 310 moves horizontally to the right and pulley 308 moves rightwards and upwards following the wall 318 of opening 314. When the validator 100 is connected, the stacker driving roller 114 applies a force against the belt 312 in the area of floating pulley 310 displacing it along slot 320. As a result, belt tension pulley 308 moves against the force of spring 316 along the wall 318 of opening 314. This movement of both pulley 308 and pulley 310 maintains the tension on belt 312 and the normal force against stacker driving pulley 114 at relatively constant values regardless of tolerances of components and ordinary wear and tear of parts.

This arrangement also results in the belt 312 being in contact with the surface of the stacker driving pulley 114 over a fairly wide angle $\omega°$ thereby preventing slippage of belt 312. Angle $\omega$ for this embodiment is approximately 25°. The portion of belt 312 labeled 322 in FIG. 5 also provides a diverting surface which helps to direct banknotes into the stacker's banknote transport means 300 and around the corner at a point where the banknote is changing its direction of travel from horizontal to vertical.

While the transport means 300 is shown in conjunction with prestorage compartment 400, pusher 500, and banknote magazine 600, it could be used to deliver banknotes to any desired banknote storage compartment.

Speed Control

Before turning to additional discussion of the banknote path and prestorage compartment 400 where a banknote is temporarily stored before being stacked, it is important to note one further aspect of the functioning of the banknote transport means 300. Since transport means 300 is frictionally driven by the stacker drive. roller 114 which is a part of the validator 100 the transfort means 300 is seen as a load by the motor of the drive means 116 of validator 100. One aspect of the banknote transport system of the validator of U.S. application Ser. No. 659,411 is that it avoids the use of complicated speed control circuitry to hold transport speed constant with variations in line voltage or in the load to be transported. The validation circuitry in this validator compensates for banknote speed variations up to 20% from normal speed without making any speed adjustments, and if this limit is exceeded by a banknote it is returned.

Figure 11:
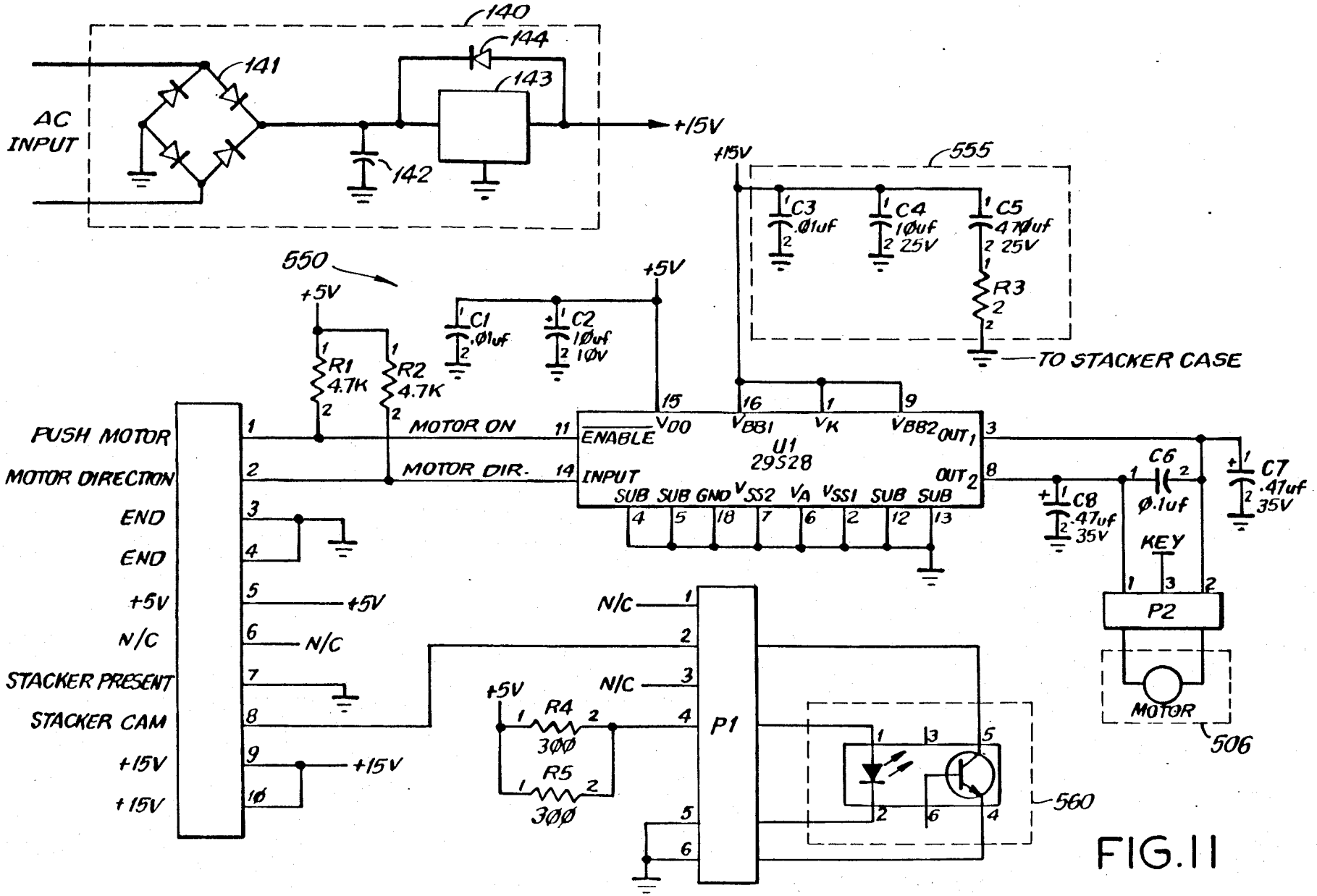
FIG. 11 is a circuit diagram of one embodiment of electronic control circuitry for controlling the operation of the pusher.

In the absence of some form of speed adjustment, the additional load presented by the stacker's transport means 300 may result in a slowing of the banknote speed in the validator 100 by an amount greater than 20%. The validator 100 and stacker 200 share a common power supply circuit 140 which is located in the validator. Circuit 140 is illustrated in FIG. 11. Briefly, a source of 15 volts (V) for both validator 100 and the pusher 500 is derived as shown at the top of FIG. 11. An AC input voltage is full wave rectified using a bridge rectifier 141. The rectified signal is then fed as an input to a capacitor 142 and a voltage regulator 143. Capacitor 142 is either small or may be omitted entirely. As a result, the input voltage of regulator 143 is unregulated or only slightly regulated and it falls below the required input voltage of regulator 143 causing the average output voltage of regulator 143 to be less than 15 V. Also connected to the voltage regulator 143 is a diode 144 which has one of its leads connected to the input of regulator 143 and its other lead connected to the regulator's output. Voltage regulator 143 produces at its output a regulated supply of 15 V only so long as the voltage at its input equals or exceeds approximately 17½ V. The stacker's electronic circuitry 550 is also illustrated in FIG. 11. As will be described below, the electronic circuitry 550, in conjunction with control signals from validator 100, controls the operation of pusher means 500. By including a capacitor 555 in the power input circuit of the circuitry 550 as shown in FIG. 11, the load presented by stacker transport means 300 is compensated for and banknotes travel through validator 100 or the combined validator (100)-stacker (200) unit at a substantially constant speed.

Banknote Path and Prestorage Compartment

Figure 12:
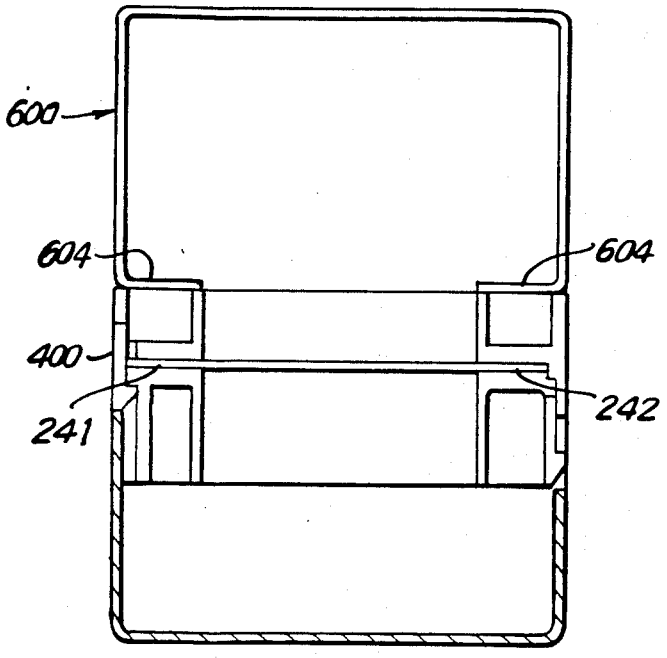
FIG. 12 is a top view of the prestorage compartment and the banknote magazine of the stacker of FIG. 1.

The initial portion of the banknote path through the stacker 200 has been previously described. Throughout the banknote path, the edges of a banknote traveling along the path are held in channels 241 and 242. The banknote passageway defined by these channels has a predetermined width in a direction perpendicular to the face of a banknote in the passageway. Preferably, this width is approximately ten times the thickness of a typical banknote. These channels are best illustrated in FIG. 12. The channel size is determined by the design and fabrication of the stacker's upper housing 202 and lower housing 208 which together define the prestorage compartment 400. The stability of these stacker parts with respect to environmental changes such as changes in temperature, humidity and pressure, and with respect to wear under normal operating conditions is important in order to insure that the sizes of the channels 241 and 242 are maintained substantially constant. Molded polycarbonate is one suitable material for the housings 202 and 208. The controlled size of the banknote path allows a banknote to freely travel along that path, but it does not allow room for the banknote to fold or buckle. Thus, jams are prevented and do not occur even when the leading edge of the banknote reaches the stop 402, and the banknote transport means 300 continues to operate.

The prestorage compartment 400 is shown in detail in FIG. 6. The inner surfaces 405 and 407 of outer sidewalls 404 and 406 of prestorage compartment 400 are spaced apart by a distance slightly greater than the width of the widest banknote which is to be accepted. Inner sidewalls 410 and 412 define the width of the channels in which the edges of the banknote travel. The central portion of prestorage compartment 400 is an open window 420 which is larger than a pusher plate 540 which is used to push the banknote from compartment 400 into banknote magazine 600.

Pusher

Figure 9:
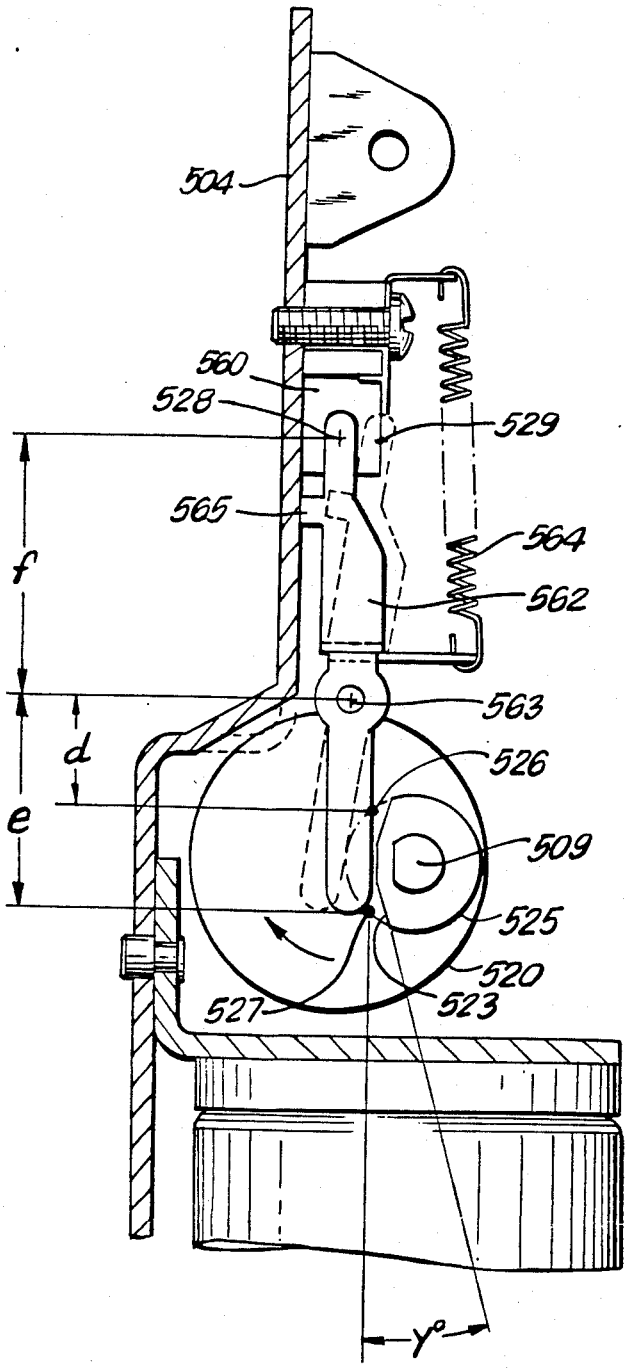
FIG. 9 is a detail drawing illustrating the cam and sensor arrangement used to monitor pusher plate position.

Pusher 500 is shown in detail in FIGS. 7-9. Pusher 500 includes a pusher actuating mechanism consisting of a chassis 504, motor 506, right angle gear train 508, two cams 520 mounted on the gear train output shaft, a pair of scissors 530, a pusher plate 540 and extension springs 546. Additionally, a position sensor switch 560, and a sensing switch activating fork 562 together with fork spring 564 are part of the pusher 500. Each scissor 530 is supported at one end by a clevis pin 531 to the pusher plate 540 and at the other end by a second clevis pin 532 to the chassis 504 through an elongated slot 534. Additionally, each scissor 530 is held against one of the cams 520 by means of the force exerted by the springs 546.

The cams 520 are eccentric and have two cam surfaces. On one side is the cam surface 521 (FIG. 7) upon which the scissors rest. On the other side is the cam surface 525 (FIG. 9) upon which the sensing switch activating fork 562 rests. The cams 520 are mounted on shaft 509 of gear train 508, and they rotate when motor 506 causes gear train 508 to turn the gear train shaft 509. Home position of the pusher plate 540 and scissors 530 is defined when the pusher plate and scissors are in their closest proximity to shaft 509 as shown in FIG. 7. The home position is maintained over a large range of cam position by providing two flat cam sides 522 as part of cam surface 521 as shown in FIG. 7. FIG. 7 shows an angle of x° between one of the cam sides 522 and scissor 530. The greater this angle x becomes, the greater the range of cam home position with respect to scissors 530 and pusher plate 540. That is, as the cam rotates about its axis 509 through the region determined by the flat sides 522 of cam surface 521 and measured by angle x, no motion is imparted by cam 520 to scissors 530 and pusher plate 540. Once cam 520 has rotated further than x° from its home position, the round portion of cam surface 521 begins to move the scissors 530 and actuator plate 540 through the window 420 in the prestorage compartment 400. As pusher plate 540 is forced through window 420, a banknote in prestorage compartment 400 is moved into banknote magazine 600 as illustrated in FIG. 8. As the cam 520 continues to rotate, the scissors 530 finally are fully extended. Then as the cam 520 returns to its home position, the force of springs 546 retract the scissors 530 and pusher plate 540. The above description briefly explains how pusher means 500 operates without considering how it fits into the operation of the overall validator-stacker unit.

For pusher means 500 to function properly, it is necessary to control the time at which motor 506 is turned on thereby causing the pusher means 500 to operate. Quite simply, the motor should be turned on shortly after a banknote has fully entered prestorage compartment 400. It should not be turned on when there is no bill in compartment 400 or when a bill is part way in compartment 400.

In the present embodiment, the electronic circuitry for controlling motor 506 is located on a printed circuit board mounted in stacker 200. The preferred embodiment of this circuitry is shown in FIG. 11 as circuit 550. Circuit 550 includes connector P1 connector P2, connector P3, motor control chip U1, sensor switch 560, motor 506, as well as, discrete resistors and capacitors connected as shown therein. It should be noted that switch 560 and motor 506 while connected to circuit 550 are not on the printed circuit board. Connector P3 makes several connections to the logic circuitry of validator 100. One connection is for a signal from validator 100 which establishes whether pusher motor 506 should be turned on or off. A second connection is for a signal from validator 100 which establishes which direction motor 506 should turn. A third connection provides a signal to validator 100 that the stacker 200 is attached to validator 100. Finally, a fourth connection provides a signal to validator 100 indicating whether the cams 520 are at home position or not. Connector P1 connects sensor switch 560 to the printed circuit board and a sensor signal through connector P3 to validator 100. Connector P2 connects pusher motor 506 to motor control chip U1 which controls the power delivered to motor 506. In response to "motor on" and "motor direction" signals from connector P1, chip U1 determines the sense with which 15 V is applied to motor 506. Since the control signals to cause circuit 550 to turn the motor 506 on and off, and to control its direction of rotation are produced by logic circuits in validator 100 such as a microprocessor control circuit, this arrangement allows the use of a single microprocessor in the validator-stacker unit rather than having one in validator 100 and one in stacker 200.

In the present embodiment a control signal to turn motor 506 on so that cam 520 rotates clockwise is produced after a sufficient time has passed for an accepted banknote to fully enter the prestorage compartment 400. Alternatively, a banknote position sensor might be used to sense that a banknote is in the proper position for stacking, and a start control signal is then produced in response to a signal from that banknote position sensor. Following a motor on signal, cams 520 begin to rotate. Once cams 520 have rotated more than x° (FIG. 7) in the clockwise direction, the scissors 530 are extended thereby pushing the pusher plate 540. In the process of extending the pusher plate 540 the banknote is pushed through opening 420 and into the banknote magazine 600 as shown in FIG. 8. The banknotes already in magazine 600 are clamped between the pusher plate 540 and pressure plate 606 which in turn is exerting a force against pressure spring 610. During this process, the edges of the bill previously in the channels 241 and 242 of the banknote path are folded inward by the side walls of opening 420 and spring back to an essentially flat position upon clearing the bill retention tabs 604. The bill is now held in the stack by the force of the pressure plate 606 and bill retention tabs 604, and the pusher plate 540 returns to its home position as shown in FIG. 7. In the preferred embodiment, the pushing sequence is repeated with the cam 520 rotating a full cycle in the counterclockwise direction to insure that banknotes are properly stacked in magazine 600. The validator is now ready to accept another bill.

In order to reverse motor rotation and to stop motor 506 at the appropriate time, sensing means are provided to sense when the cams 520 have completed a first rotation and returned to their home position for the first time, and also to sense when a second rotation has been completed. Also in the preferred embodiment, a maximum time is allowed for a complete push to be completed. If this time is exceeded, the motor 506 is de-energized and the magazine 600 is either full, or a jam or other malfunction has occurred.

A suitable sensor switch arrangement is shown in FIG. 9. This arrangement makes use of the cam surface 525 on the opposite side of cam 520. It consists of a position sensing switch 560 mounted to chassis 504 and a switch activating fork 562. Fork 562 is supported and pivoted around pin 563. The fork 562 has a stop point 565 near its end closest the switch 560 to insure it is located in a predetermined location so that it is interrupting switch 560 when cam 520 is in its home position. This position of fork 562 is its stop position. The other end of the fork 562 is positioned relative to the cam surface 525 of cam 520. The fork 562 is biased to its stop position by the tension of a spring 564. The stop position is also known as the home position of fork 562 and corresponds to the home position of cam 520. The cam surface 525 of cam 520 is designed so that when it is in its home position the fork 562 is then closest in proximity to shaft 509. The cam surface 525 is in its home position during the time that cam surface 521 is in its home position.

The breadth of the home position for the fork 562 is determined by virtue of the cam shape on cam surface 525 just as discussed for cam surface 521. This cam shape may include two flat sides 523 at an angle of y° from the line drawn through points 526 and 527 of FIG. 9.

When cam 520 rotates, cam surface 525 rotates and cause fork 562 to pivot. This causes the end of the switch activating fork 562 to move from position 528 to position 529 as illustrated in dashed lines in FIG. 9. This movement causes the switch 560 to change electrical state thereby indicating a non-home condition. The determination of the sensed home vs. non-home condition of fork 562 is related to the combination of distances "f", "d" and "e" of FIG. 9 and angle y between the cam surface 525 and the actuating fork 562.

The design of the sensor switch activating arrangement is such that the sensed return to home position occurs at a time after the pusher plate 540 is actually in its home position and indicates non-home before the pusher plate 540 actually leaves its actual home position. This is illustrated by FIG. 10.

Figure 10:
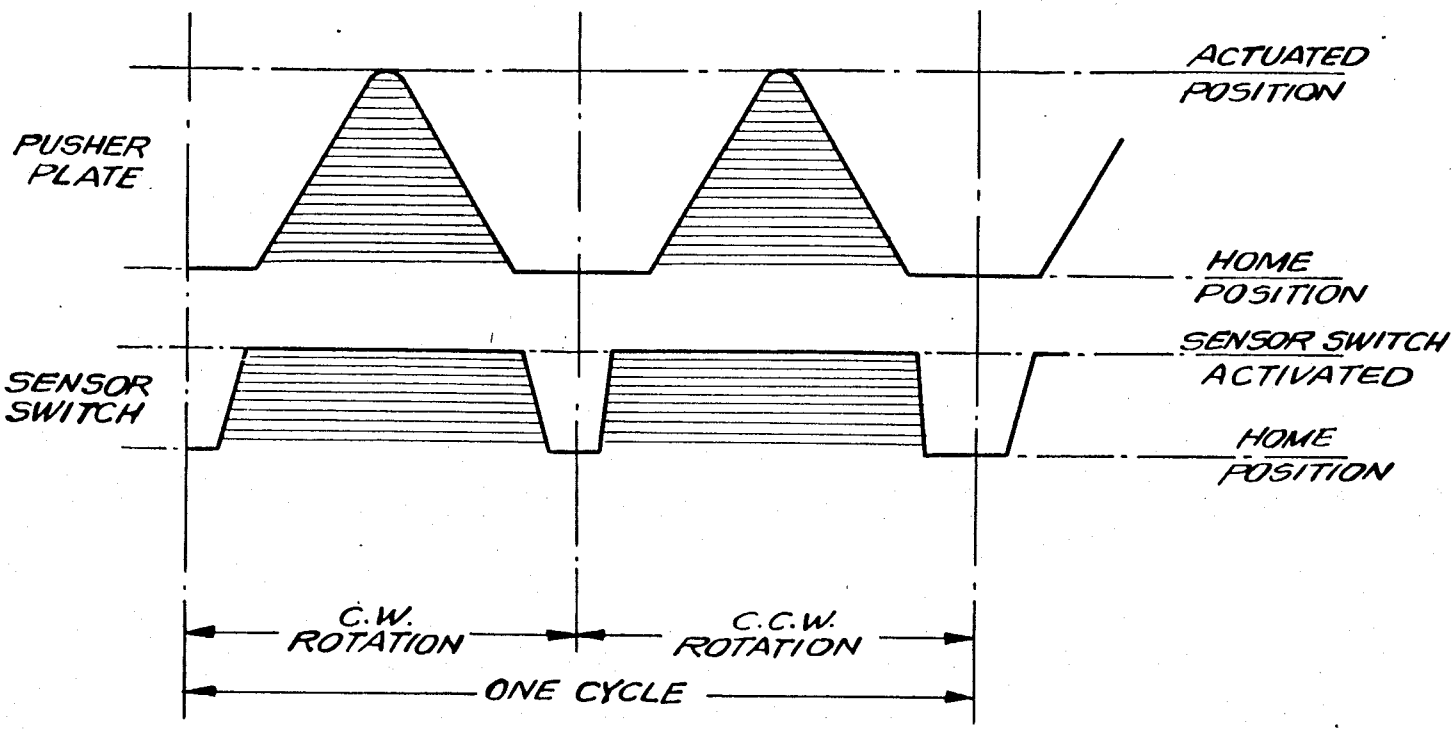
FIG. 10 is a pair of graphs illustrating the cycle of operation of the pusher plate and the sensor arrangement.

The relationship of the angles x and y of the flat sides 522 on cam surface 521 and the flat sides 523 on cam surface 525, as well as the distances "f", "d", and "e" of FIG. 9, provides an actual home position of the pusher plate 540 of about 25% of the revolution of the cams 520 while providing a sensed home of about 13% of the revolution of the cams 520 as illustrated in FIG. 10. Thus tolerance is provided which allows an open loop motor control system and which allows coasting or reversing with a fixed brake (reverse motor direction) time. Without such an arrangement, a more expensive and sophisticated motor control system may be required.

While the pusher 500 is shown as used with transport means 300, prestorage compartment 400, and banknote magazine 600, in other embodiments, it might be used with any suitable banknote positioning means for receiving banknotes from a validator and positioning them properly relative to the pusher plate 540, and any suitable banknote storage compartment for facially stacking banknotes.

Banknote Magazine

The banknote magazine 600 is a separable unit used to store the collected and stacked banknotes. The number of banknotes stacked and stored can be varied by changing the magazine's depth 601 to any arbitrary size. The magazine 600 can be readily attached to or detached from the remainder of stacker 200 in the factory or in the field. The magazine 600 is fastened to the remainder of stacker 200 by a pivoting clevis pin 620 which allows the magazine to rotate open and close for easy banknote removal. A spring clip 622 located at the top of stacker 200 is used to hold the magazine 600 in its closed position.

The magazine 600 consists of the magazine enclosure 602, bill retention tabs 604, pressure plate 606, and a pressure spring 610 which is retained in place by clevis pin 611 as shown in FIGS. 7 and 12. Additionally, the magazine 600 has a top access door 612 with hinge pin 613 and spring 614. Side doors 615 for side access are provided with side door pins (not shown) and springs (not shown).

Banknotes may be removed from the magazine 600 by lifting the spring clip 622 to allow the magazine to be tilted open and the top door 612 to be opened giving access to the stacked bills. For applications where the top door 612 is no accessible or there is no room to tilt open the magazine 600, side doors 615 can be opened and the banknotes removed from the side.

The pressure plate 606 is located inside the magazine enclosure 602 and is guided by means of a slot 616 in the base of enclosure 602, and by a guiding tab 617 on the pressure plate 606. The pressure plate 606 is biased against the banknote retention tabs 604 by the force of pressure spring 610. The pressure spring 610 is supported in place by the clevis pin 611. The pressure spring 610 is preferably a double torsion spring so that it takes up a minimum of space in magazine 600, thus allowing the largest possible space for stacking banknotes. The design of the pressure spring 610 is such that its range of angular rotation during operation of the stacker 200 is small relative to the number of coils in the spring. Consequently, the operating force of the pressure spring 610 against pressure plate 606 is relatively constant. Further, the same spring arrangement can be used with stackers of different capacities with the total range of angular rotation during operation still being relatively small so that a relatively constant force against pressure plate 606 is always maintained regardless of the size of magazine 600. This allows the use of the same stacker drive unit without modification for various capacity magazines 600 as all magazines will present a common load. Preferably this common load is relatively low so that a small economical motor 506 can be used to drive pusher 500.

I claim:

1. An improved banknote stacker for use with a separate banknote validator having a drive means and a banknote output, said banknote stacker comprising a banknote magazine for storage of facially stacked banknotes;

a prestorage compartment;

a pusher means for pushing a banknote in a direction perpendicular to a face of said banknote from said prestorage compartment into said banknote magazine; banknote receiving means defining an initial banknote passageway within said banknote stacker, for receiving banknotes edgewise and one at a time from said banknote validator; and bandnote transporting means for transporting banknotes edgewise from the banknote receiving means to said prestorage compartment;

wherein the improvement comprises:

said banknote receiving means comprising passageway walls defining said initial banknote passageway;

interconnection means for aligning said banknote receiving means with the banknote output of said banknote validator to form a smooth and uninterrupted passageway wall surface from the banknote output of the banknote validator to the initial banknote passageway of the banknote stacker;

said banknote transporting means engaging the drive means of said banknote validator and providing substantially continuous positive contact control over banknotes from the output of the banknote validator to the prestorage compartment of the banknote stacker whereby the leading edge of said banknote is substantially prevented from jamming; and said interconncetion means and said banknote transporting means are readily disconnectable from said banknote validator.

2. The stacker of claim 1 wherein the stacker further comprises an outer casing having at least one slot for alignment with the separate banknote validator.

3. The stacker of claim 1 wherein the drive means of the separate banknote validator comprises at least one drive roller mounted on a shaft, said shaft having at least one end extending outside the casing of the banknote validator whereby at least one slot in the outer casing of the banknote stacker receives at least one end of the shaft when the banknote stacker is attached to the banknote validator in insure their proper alignment.

4. An improved banknote stacker for use with a separate banknote validator having a drive means and a banknote output, said banknote stacker comprising a banknote magazine for storage of facially stacked banknote;

a prestorage compartment;

a pusher means for pushing a banknote in a direction perpendicular to a face of said banknote form said prestorage compartment into said banknote magazine;

banknote receiving means defining a banknote passageway within said banknote stacker, for receiving banknotes edgewise and one at a time from said banknote validator and conveying banknotes edgewise to said prestorage compartment;

wherein the improvement comprises:

interconnection means having at least one finger and at least one slot which mesh with a corresponding finger and slot at the validator banknote output along the path traversed by the leading edge of the banknote for aligning said banknote receiving means with the banknote output of said banknote validator to form a smooth and uninterrupted passageway wall surface from the banknote output of the banknote validator to the initial banknote passageway of the banknote stacker.

5. The apparatus of claim 4 wherein the banknote receiving means further comprises banknote transporting means.

6. The stacker of claim 1 or 5 wherein said banknote transporting means comprises a belt-pulley arrangement comprising at least one belt for transporting banknotes edgewise and a plurality of pulleys, said belt-pulley arrangement comprises a floating pulley which is mounted on and free to rotate about a first shaft located in a first slot in a housing of the stacker, said first shaft being mounted in the first slot whereby when the stacker is connected to the banknote validator, and the floating pulley is movably self adjusting as a result of the first shaft moving in the first slot to maintain suitable belt tension.

7. The stacker of claim 6 wherein the belt-pulley arrangment further comprises a belt tension pulley which is mounted on a free to rotate about a second shaft located in a first opening in the housing of the stacker, said second shaft being spring mounted in the first opening in the housing whereby when the stacker is connected to the banknote validator, the belt tension pulley is movably self adjusting as a result of the second shaft moving in the first opening against its spring mounting.

8. The stacker of claim 7 wherein the first opening is defined by an angled wall of the stacker housing, said angled wall being at an angle to the first slot.

9. The stacker of claim 1 or 5 wherein the banknote transporting means comprises a self-adjusting belt pulley arrangement including a belt tension pulley which is mounted on and free to rotate about a first shaft located in a first opening in the housing of the stacker, said first shaft being spring mounted in the opening in the housing whereby when the stacker is connected to the banknote validator, the belt tension pulley being movably self adjusting as the first shaft moves in the first opening against its spring mounting.

10. The stacker of claim 9 wherein the first opening comprises an angled wall of the stacker housing.

11. The stacker of claim 1 or 4 wherein the prestorage compartment is defined by an upper and a lower housing of molded plastic.

12. The stacker of claim 1 or 4 wherein said banknote magazine comprises a pressure plate, a pressure spring, and banknote retention tabs whereby said pressure plate is biased to hold banknotes in a stack against said banknote retention tabs and said pressure spring is a double torsion spring mounted on a clevis pin, said clevis pin mounted so as to maximize space for banknote stacking.

13. The stacker of claim 1 or 4 wherein said pusher means comprises a scissors arrangement having a home position; a cam having a first cam surface for driving said scissors arrangement and a second cam surface operating a position sensing means for sensing the position of said scissors arrangement; and a pusher plate connected to said scissors arrangement.

14. The stacker of claim 13 wherein the home position sensing arrangment includes a sensing fork and a sensor switch which is activated by the sensing fork.

15. The stacker of claim 14 wherein the scissors arrangement and the pusher plate are in the home position during a substantial portion of the rotation of the cam due to the shape of said cam, thereby allowing a simple motor control arrangement.

16. The stacker of claim 15 wherein the scissors arrangement and the pusher plate are in the home position during approximately 25 percent of the rotation of the cam.

17. The stacker of claim 15 wherein the home position sensing arrangement detects a sensed home condition during a smaller portion of the rotation of the cam than the substantial portion of the rotataion of the cam in which the scissors arrangement and the pusher plate are actually in the home position.

18. The stacker of claim 17 wherein the sensed home condition occurs during a range of from one-half to seven-eighths of the substantial portion of the rotation of the cam in which the scissors arrangement and the pusher plate are actually in the home position.

19. An improved banknote stacker for use with a separate banknote validator having a banknote output, said banknote stacker comprising a banknote storage compartment for stacker of banknotes;

a pusher means for pushing a banknote in a direction perpendicular to a face of said banknote into said banknote storage compartment;

banknote positioning means for receiving banknotes from said banknote validator and positioning banknotes in a position relative to the pusher means;

wherein the improvement comprises:

said pusher means comprising a cam for driving a scissors arrangement; and a position sensing means for sensing the position of the scissors arrangement;

said cam having a first cam surface and a second cam surface, the first cam surface driving the scissors arrangement, and the second cam surface operating the position sensing means.

20. The stacker of claim 19 wherein the first cam surface is shaped so that the scissors arrangement is in a home position during a first substantial portion of the rotation of the cam.

21. The stacker of claim 20 wherein the second cam surface is shaped so that the position sensing means detects that the scissors arrangement is in its home position during a second substantial portion of the rotation of the cam which is less than said first substantial portion.

22. An improved banknote stacker for use with a separate banknote validator having a drive means and a banknote output, said banknote stacker comprising a banknote storage compartment;

a pusher means for pushing a banknote in a direction perpendicular to a face of said banknote into said banknote storage compartment;

banknote receiving means defining the initial banknote passageway within said banknote stacker, for receiving banknotes edgewise and one at a time form said banknote validator; and banknote transporting means for transporting banknotes edgewise from the banknote receiving means to said banknote storage compartment;

said banknote transporting means comprising a self-adjusting belt-pulley banknote transporting means which engages the drive means of said banknote validator and provides substantially continuous positive contact control over banknotes from the output of the banknote validator to the banknote storage compartment whereby the leading edge of said banknote is substantially prevented from jamming; and said banknote transporting means being radially disconnectable from said banknote validator.

23. The stacker of claim 22 wherein the self-adjusting belt-pulley banknote transporting means further comprises a floating pulley which is mounted on and free to rotate about a first shaft located in a first slot in a housing of the stacker, said shaft being mounted in the first slot whereby when the stacker is connected to a banknote validator, the floating pulley is movably self adjusting as a result of the shaft moving in the slot.

24. The stacker of claim 23 wherein the self-adjusting belt-pulley banknote transporting means further comprises a belt tension pulley which is mounted on and free to rotate about a second shaft located in a first opening in a housing of the stacker, said second shaft having a spring mounting in the first opening in the housing whereby when the stacker is connected to the banknote validator, the belt tension pulley is self adjusting as the second shaft moves in the first opening against the spring mounting.

25. The stacker of claim 22 wherein the self-adjusting belt-pulley banknote transporting means further comprises a belt tension pulley which is mounted on and free to rotate about a first shaft located in a first opening in a housing of the stacker, said first shaft having a spring mounting in the first opening in the housing whereby when the stacker is connected to the banknote validator, the belt tension pulley is movably self adjusting as a result of the first shaft moving in the first opening against the spring mounting.

26. The stacker of claim 24 or claim 25 wherein the first opening comprises an angled wall of the stacker housing, said angled wall being at an angle for aiding in maintaining a relatively constant tension on the belt of the belt-pulley arrangement and for maintaining a relatively constant normal force on a banknote being transported by the transporting means.

27. The stacker of claim 24 wherein the floating pulley and the belt tension pulley are arranged in connection with a belt so that said belt provides a diverting surface and helps to direct the banknote from the validator into the stacker.

28. The stacker of claim 24 wherein the belt-pulley arrangement further comprises a locating pulley and a roller mounted on opposite sides of the banknote passageway.

29. The stacker of claim 28 wherein the roller is mounted on a leaf spring.

30. The stacker of claim 29 wherein the leaf spring is selected so that a sufficient force to drive a banknote into the banknote storage compartment is produced by the locating pulley and the roller, but an insufficient force is provided to crumple the banknote once the banknote is fully into the banknote storage compartment.

* * * * *

UNITED STATES PATENT AND TRADEMARK OFFICE

CERTIFICATE OF CORRECTION

PATENT NO. : 4,765,607

DATED : August 23, 1988

INVENTOR(S) : Zouzoulas

It is certified that error appears in the above—identified patent and that said Letters Patent is hereby corrected as shown below:

Column 7, line 34, insert --of-- after "angle".

Column 7, line 55, delete the "." following "drive".

Column 7, line 56, delete "transfort", and insert --transport--.

Column 11, line 25, delete "cause", and insert --causes--.

Column 12, line 19, delete "no" following "door" 612 is", and insert --not--.

Column 12, claim 1, line 57, insert --directly-- following "compartment".

Column 12, claim 1, line 62, delete "bandnote" preceeding "transporting", and insert --banknote--.

Column 13, claim 1, line 15 delete "interconncetion" following "said", and insert --interconnection--.

Column 13, claim 3, line 28, delete "in" following "validator", and insert --to--.

Column 13, claim 4, lines 33-34, delete "banknote", and insert --banknotes--.

Column 13, claim 4, line 37, delete "form" following "banknote", and insert --from--.

UNITED STATES PATENT AND TRADEMARK OFFICE

CERTIFICATE OF CORRECTION

PATENT NO. : 4,765,607

DATED : August 23, 1988

INVENTOR(S) : Zouzoulas

It is certified that error appears in the above—identified patent and that said Letters Patent is hereby corrected as shown below:

Column 14, claim 7, line 5, delete "a" following "on", and insert --and--.

Column 14, claim 9, line 20, delete "the" following "opening in", and insert --a--.

Column 14, claim 17, line 60, delete "rotataion" following "of the", and insert --rotation--.

Column 15, claim 19, line 4, delete "stacker" following "for", and insert --storage--.

Column 15, claim 22, line 40, delete "form" preceeding "said", and insert --from--.

Column 15, claim 22, line 53, delete "radially" following "being", and insert --readily--.

UNITED STATES PATENT AND TRADEMARK OFFICE

CERTIFICATE OF CORRECTION

PATENT NO. : 4,765,607

DATED : August 23, 1988

INVENTOR(S) : Zouzoulas

It is certified that error appears in the above-identified patent and that said Letters Patent is hereby corrected as shown below:

Column 16, claim 25, line 23, delete "a" following "in", and insert --the--.

Signed and Sealed this

Twenty-seventh Day of June, 1989

*Attest:*

DONALD J. QUIGG

*Attesting Officer*

*Commissioner of Patents and Trademarks*